US010898752B1

(12) United States Patent
Kehoe

(10) Patent No.: US 10,898,752 B1
(45) Date of Patent: Jan. 26, 2021

(54) FOLDABLE EXERCISE DEVICE

(71) Applicant: Michael Kehoe, Dublin (IE)

(72) Inventor: Michael Kehoe, Dublin (IE)

( * ) Notice: Subject to any disclaimer, the term of this patent is extended or adjusted under 35 U.S.C. 154(b) by 0 days.

(21) Appl. No.: 17/006,752

(22) Filed: Aug. 28, 2020

Related U.S. Application Data

(63) Continuation of application No. 16/945,864, filed on Aug. 1, 2020.

(51) Int. Cl.

| | |
|---|---|
| ***A63B 21/16*** | (2006.01) |
| ***A63B 21/00*** | (2006.01) |
| ***A63B 23/035*** | (2006.01) |
| ***A63B 23/12*** | (2006.01) |

(52) U.S. Cl.
CPC ..... *A63B 21/1636* (2013.01); *A63B 21/1627* (2013.01); *A63B 21/4035* (2015.10); *A63B 23/03525* (2013.01); *A63B 23/1218* (2013.01); *A63B 2210/50* (2013.01)

(58) Field of Classification Search
CPC ..... A63B 21/1636; A63B 21/4035; A63B 23/1218; A63B 23/03525; A63B 21/1627; A63B 2210/05; A63B 23/12–1281
See application file for complete search history.

(56) References Cited

U.S. PATENT DOCUMENTS 3,593,708 A * 7/1971 Steele ..... A63B 21/1627 602/32
4,662,629 A * 5/1987 Plovie ..... A63B 21/00047 182/206
5,299,990 A * 4/1994 Mehlhoff ..... A63B 23/00 482/115
5,871,422 A * 2/1999 Elbogen ..... A63B 3/00 482/40
6,508,743 B1 * 1/2003 Fortin ..... A63B 1/00 482/38
7,108,636 B1 * 9/2006 Garcia ..... A63B 21/1627 482/139
8,808,147 B2 * 8/2014 Gillespie ..... A63B 1/00 482/39
9,044,629 B2 * 6/2015 Ross ..... A63B 23/1218
9,044,641 B2 * 6/2015 Velikin ..... A63B 21/00047
9,079,085 B2 * 7/2015 McBride ..... A63B 21/068
9,114,273 B2 * 8/2015 Kehoe ..... A63B 21/00047
(Continued)

*Primary Examiner* — Andrew S Lo
(74) *Attorney, Agent, or Firm* — Richard G. Topolewski

(57) ABSTRACT

A foldable exercise device with a chin-up exercise apparatus and a dip exercise apparatus suspendable from the chin-up exercise apparatus. The chin-up exercise apparatus has a top horizontal member and a bottom horizontal member connected by two connecting members. Each connecting member has a door header hook and a parallel chin-up handle that rotate on the connecting member from a flat configuration to an exercise configuration. In the exercise configuration the chin-up exercise apparatus can engage a door frame. In the exercise configuration the parallel chin-up handles can be used for neutral chin-ups. The dip exercise apparatus has two vertical members spaced apart by a horizontal connecting member. The vertical members have a bottom end with a bottom grip. The bottom grip can be rotated from a flat configuration to an exercise configuration. In the exercise configuration the bottom grips can be used to do dip exercises.

19 Claims, 7 Drawing Sheets

(56) References Cited

U.S. PATENT DOCUMENTS

| | | | | |
|---|---|---|---|---|
| 9,452,308 | B2 * | 9/2016 | Lentz | A63B 21/1627 |
| 9,604,086 | B2 * | 3/2017 | Meredith | A63B 21/068 |
| 9,744,399 | B2 * | 8/2017 | Sheeler | A63B 23/1218 |
| 9,868,006 | B1 * | 1/2018 | Epler | A63B 21/1636 |
| 10,449,416 | B2 * | 10/2019 | Dalebout | A63B 24/0062 |
| 10,780,311 | B1 * | 9/2020 | Gadd | A63B 23/0405 |
| RE48,236 | E * | 10/2020 | Kehoe | A63B 21/1636 |
| 2010/0234193 | A1 * | 9/2010 | Friedman | A63B 21/00047 482/133 |
| 2011/0245040 | A1 * | 10/2011 | Skipper | A63B 21/1636 482/38 |
| 2012/0046150 | A1 * | 2/2012 | Stacey | A63B 21/00047 482/131 |
| 2013/0040784 | A1 * | 2/2013 | Gillespie | A63B 1/00 482/39 |
| 2013/0116093 | A1 * | 5/2013 | Kehoe | A63B 221/1627 482/40 |
| 2013/0178338 | A1 * | 7/2013 | Ross | A63B 21/1645 482/40 |
| 2013/0244836 | A1 * | 9/2013 | Maughan | A63B 21/068 482/40 |
| 2015/0005142 | A1 * | 1/2015 | Crisp | A63B 21/4035 482/129 |
| 2015/0148197 | A1 * | 5/2015 | Lentz | A63B 21/1618 482/40 |
| 2015/0258359 | A1 * | 9/2015 | Velikin | A63B 1/00 482/40 |
| 2016/0166874 | A1 * | 6/2016 | Sheeler | A63B 21/068 482/40 |

* cited by examiner

100

700

FOLDABLE EXERCISE DEVICE

CROSS-REFERENCE TO RELATED APPLICATION

This application is a continuation of prior application Ser. No. 16/945,864, filed Aug. 1, 2020.

BACKGROUND OF THE INVENTION

Field of the Invention

The present disclosure relates generally to an exercise device, more specifically a door mount exercise device.

Description of the Related Art

Home exercise devices that mount in a doorway for doing chin-up, pullup, dips and other exercises are available. Typically, these exercise devices are bulky and difficult to store, and fail to provide parallel chin up bars for neutral grip chin-ups. Often user of these devices can be in small homes or apartments where space is at a premium and they would like to be able to take down the exercise device and have it 'disappear' and take up as little space as possible for easy storage.

Therefore, there is a need for a door mount exercise device that can provide parallel chin-up bars and is able be stored in a small space.

SUMMARY OF THE INVENTION

In accordance with the teachings of the present disclosure, a foldable exercise device is provided that has a chin-up exercise apparatus and a dip exercise apparatus suspendable from the chin-up exercise apparatus. The chin-up exercise apparatus has a top horizontal member and a bottom horizontal member connected by two connecting members.

Each connecting member has a door header hook and a parallel chin-up handle that rotate on the connecting member from a flat configuration to an exercise configuration. The door header hook and parallel chin-up handle are on opposite sides of the two connecting members. In the exercise configuration the chin-up exercise apparatus can releasably engage a door frame with the bottom horizontal member contacting the front side of the door frame by pressing against the vertical door jams of the door frame and the door header hook can engaging with the back side of the door by contacting a door frame header. In the exercise configuration the parallel chin-up handles can be used to do neutral chin-ups.

The dip exercise apparatus is suspendable from the chin-up exercise apparatus. The dip exercise apparatus has two vertical members, where each vertical member has a top end and a bottom end. The top end is configured to suspend the dip exercise apparatus from the chin-up exercise apparatus. The bottom end has a bottom grip, where the bottom grip can be rotated from a flat configuration to an exercise configuration. The two vertical members are spaced apart at a predefined distance by a horizontal connecting member. In the exercise configuration the bottom grips are substantially perpendicular to the two vertical members and the horizontal connecting member and when suspended from the chin-up exercise apparatus can be used to do dip exercises. In the flat configuration the bottom grips and the horizontal connecting member are substantially parallel.

Rotation of the door header hook may cause rotation of the parallel chin-up handle.

The connecting member is straight with a round cross section and there is a sleeve that is around the connecting member, where the door header hook and the parallel chin-up handle are attached to the sleeve.

The foldable exercise device may further include a chin-up bar biasing mechanism, where the chin-up bar biasing mechanism biases the parallel chin-up handle into the exercise configuration. The chin-up bar biasing mechanism may include a sleeve that is around the connecting member, and the door header hook and the parallel chin-up handle are attached to the sleeve, where the connecting member is a tube with a circular cross section, the tube has an axis and there is a slot in the tube running parallel to the axis in which passes a first pin that is perpendicular to the axis of the connecting member. The first pin extends beyond the connecting member. Pushing on the first pin is a spring that is inside the connecting member. The first pin pushes on the sleeve, the other end of the sleeve is pushing against a second pin that goes through the connecting member. The sleeve has a detent for the second pin to move into that biases the sleeve to the exercise configuration.

The horizontal connecting member may be foldable.

The foldable exercise device may also include a bottom grip biasing mechanism that biases the bottom grip to the exercise configuration. The bottom grip biasing mechanism may include a sleeve that is around the vertical members and the rotatable handle is attached to the sleeve. The vertical member is a tube with a circular cross section and there is a slot in the tube running parallel to the axis in which passes a pushing pin that is perpendicular to the axis of the vertical member. The pushing pin extends beyond the vertical member. Pushing on the pushing pin is a spring that is inside the vertical member. The pushing pin pushes the sleeve, the other end of the sleeve is pushing against a retaining pin that goes through the vertical member. The sleeve has a detent for the retaining pin to move into that biases the sleeve to the exercise configuration.

Additional features of the present invention will become apparent from the following description and appended claims, taken in conjunction with the accompanying drawings.

DETAILED DESCRIPTION OF THE INVENTION

Figure 1:
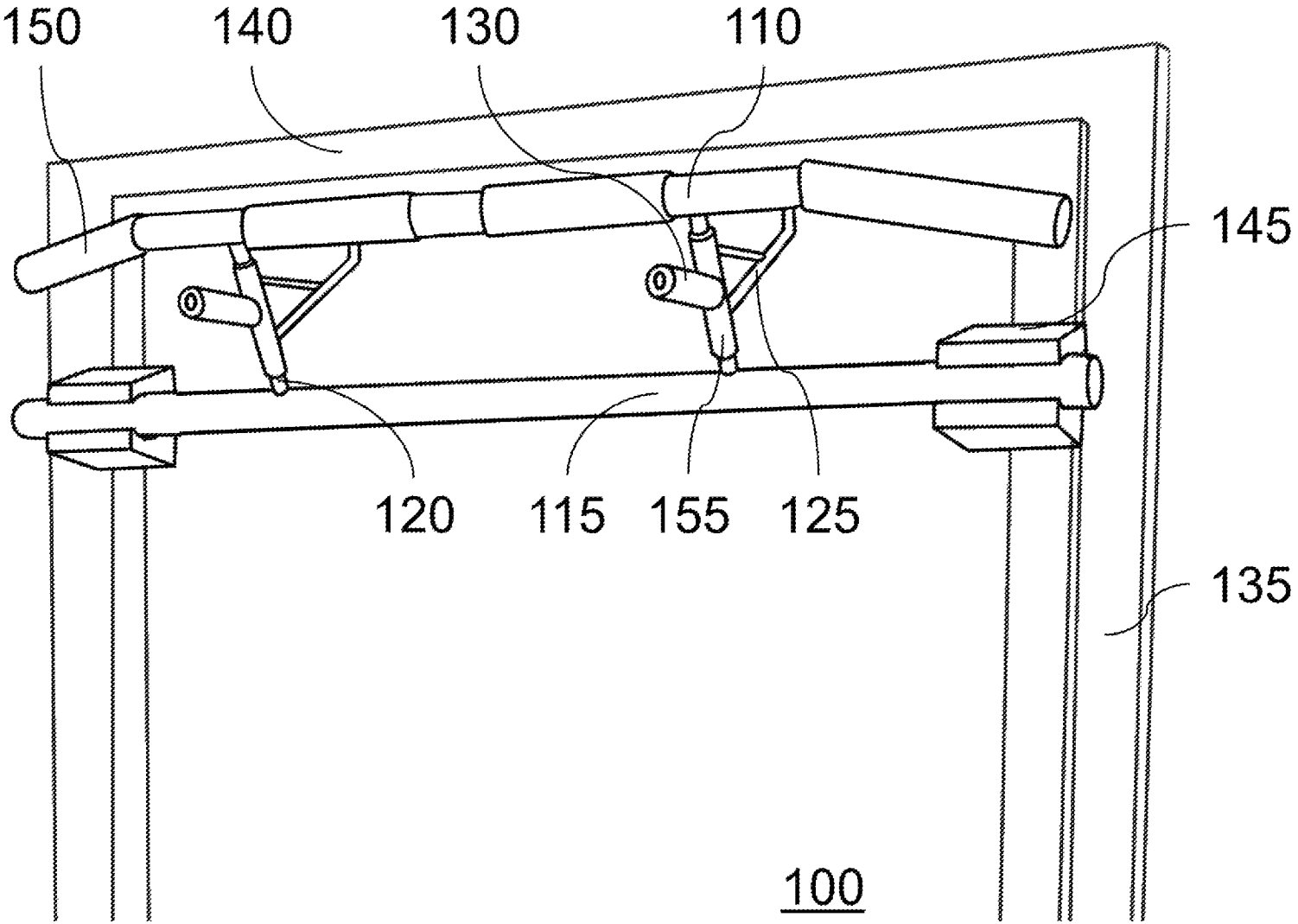
FIG. 1 illustrates a chin-up apparatus in an exercise configuration secured to a door frame.

FIG. 1 illustrates a chin-up apparatus 100 in an exercise configuration that allows a user to do neutral chin-ups. The chin-up apparatus 100 has a top horizontal member 110 and a bottom horizontal member 115 that are connected together spaced apart by two connecting members 120.

The top horizontal member 110 may be straight or contoured with various bends (for example as shown) to allow for more grip options for doing exercises and thus enable a user to exercise slightly different muscles. The top horizontal member 110 may have foam cushioning 150 at various places, for example on the outer most part or in the middle, spaced shoulder-width apart. The foam cushioning provides comfort and grip when grasping during exercises. The top horizontal member 110 should be wide enough to span most door openings, for example 39 inches long.

The connecting member 120 is shown with a sleeve 155, a door header hook and a parallel chin-up handle 130. The connecting member 120 is straight with around cross section and the sleeve 155 is around the connecting member 120. The door header hook 125 is attached to the connecting member via the sleeve 155, and the door header hook 125 extends away from the connecting member 120. The parallel chin-up handle 130 is also attached to the connecting member via the sleeve 155 and is shown extending away from the connecting member 120 in the direction opposite the door header hook 125. The door header hook 125 and the parallel chin-up handle 130 may rotate on the connecting member 120 via the sleeve 155.

In the exercise configuration, the door header hooks 125 and the parallel chin-up handles 130 are roughly perpendicular to the bottom horizontal member 115. The chin-up apparatus 100 can be releasably engaged with a door frame, for example the door header hooks 125 can be engaged with the back side of a door frame header 140. The door header hooks 125 can be in any number of shapes that allow the door header hooks 125 to securely hold to the back side of the door frame header 140. For example, the engagement part of the door header hook may be hooked over the top lip of the frame, or the door header hook may just press up against the frame. The bottom horizontal member 115 can press against the front of vertical door jams 135. The bottom horizontal member 115 may press directly against the vertical door jams 135 or press through frame protectors 145. Frame protectors 145 may allow the force to be distributed over a larger area and may allow for more grip to help prevent the chin-up apparatus 100 from slipping down. When weight is applied to the top horizontal member, like a user suspending themselves, the device will provide the counter balance to the force with a torque to keep the top horizontal member 110 stationary with the door header hook 125 pulling back because of the force coming from the back of the top frame and the bottom horizontal member 115 pushing forward with the pressure from the front of the vertical door jams 135. The friction and possible the top hook being over the lip of the top frame can ensure that the chin-up apparatus 100 remain sturdily attached to the door frame, especially with the extra weight when being used for exercise.

With the chin-up apparatus 100 engaged with a door frame a user can do neutral chin-ups using the parallel chin-up handles 130 that can extend away from the door frame parallel to each other. The parallel chin-up handles 130 may have foam cushioning. A user can also support themselves from the top horizontal member 110 to do various exercises like chin-ups, pull ups of various width and other exercises.

Figure 2:
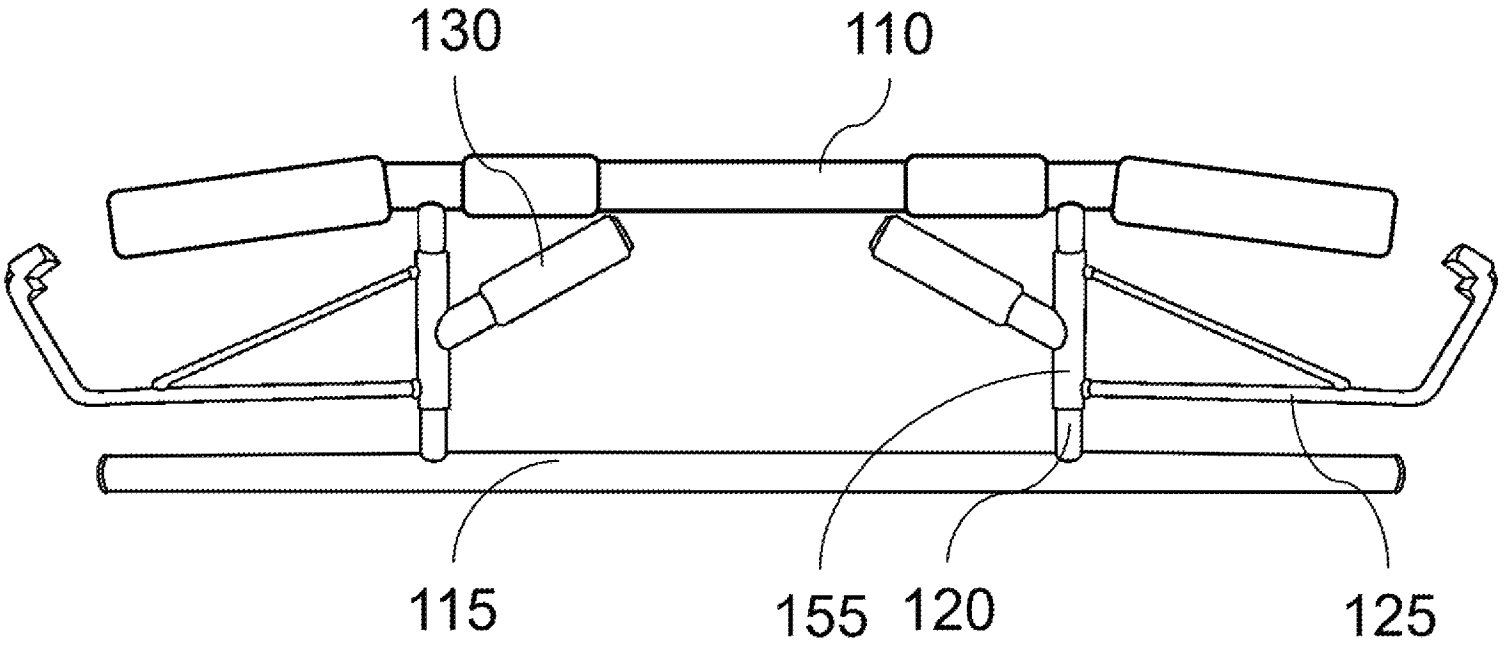
FIG. 2 illustrates the chin-up apparatus in a flat configuration.

FIG. 2 illustrates the chin-up apparatus 100 in a flat configuration with the door header hook 125, the parallel chin-up handle 130, the two connecting members 120, the top horizontal member 110 and the bottom horizontal member 115 substantially coplanar. The flat configuration allows the chin-up apparatus 100 to be stored in compact spaces such as in a closet, under a bed, under a sofa or other compact spaces.

Transitioning between the exercise configuration and the flat configuration may be a matter of the door header hook 125 and the parallel chin-up handle 130 transitioning from being in a plane perpendicular to the bottom horizontal member 115 to being co-planer with the bottom horizontal member 115. The door header hook 125 and the parallel chin-up handle 130 may rotate around the connecting member 120. The sleeve 155 is shown as a single piece and the door header hook 125 and the parallel chin-up handle 130 are shown rigidly attached such that rotation of the door header hook 125 also causes the chin parallel chin-up handle 130 to rotate. Although the door header hooks 125 and the parallel chin-up handle 130 are shown rigidly attached other configurations are possible that allow them to rotate independent of each other, for example by having two sleeves 155 on the connecting member 120, where one for the parallel chin-up handle 130 and one from the door header hook. Another example may be the chin-up handles being able to rotate 270 degrees before contacting the door header hook 125 so that it starts rotating. As shown the parallel chin-up handle 130 may rotate to the inside between the connecting members 120 and the door header hook 125 may rotate to the outside. In an alternative configuration the door header hook 125 may rotate to the inside between the connecting members 120 and the parallel chin-up handles 130 may rotate to the outside. If the door header hooks 125 and the parallel chin-up handles 130 are not rigidly attached, they could even rotate to the same side of the connecting member 120 and thus allow other configurations and lengths not constrained to the space between the connecting members 120.

The chin-up apparatus 100 may have a biasing mechanism that helps put and keep chin-up apparatus 100 in the exercise configuration. In addition, the biasing mechanism may help put and keep the chin-up apparatus 100 in the flat configuration. For example, the biasing mechanism may help hold the door header hook 125 and the parallel chin-up handle 130 in the perpendicular position by requiring extra force to move out of the perpendicular position. In addition, when close to the perpendicular position the biasing mechanism may help move the door header hook 125 and the parallel chin-up handle 130 into to the perpendicular position. Similarly, the biasing mechanism may have a second bias for the parallel chin-up handle 130 and the door header hook 125 to be coplanar with the bottom horizontal member 115 for the flat configuration.

Figure 3:
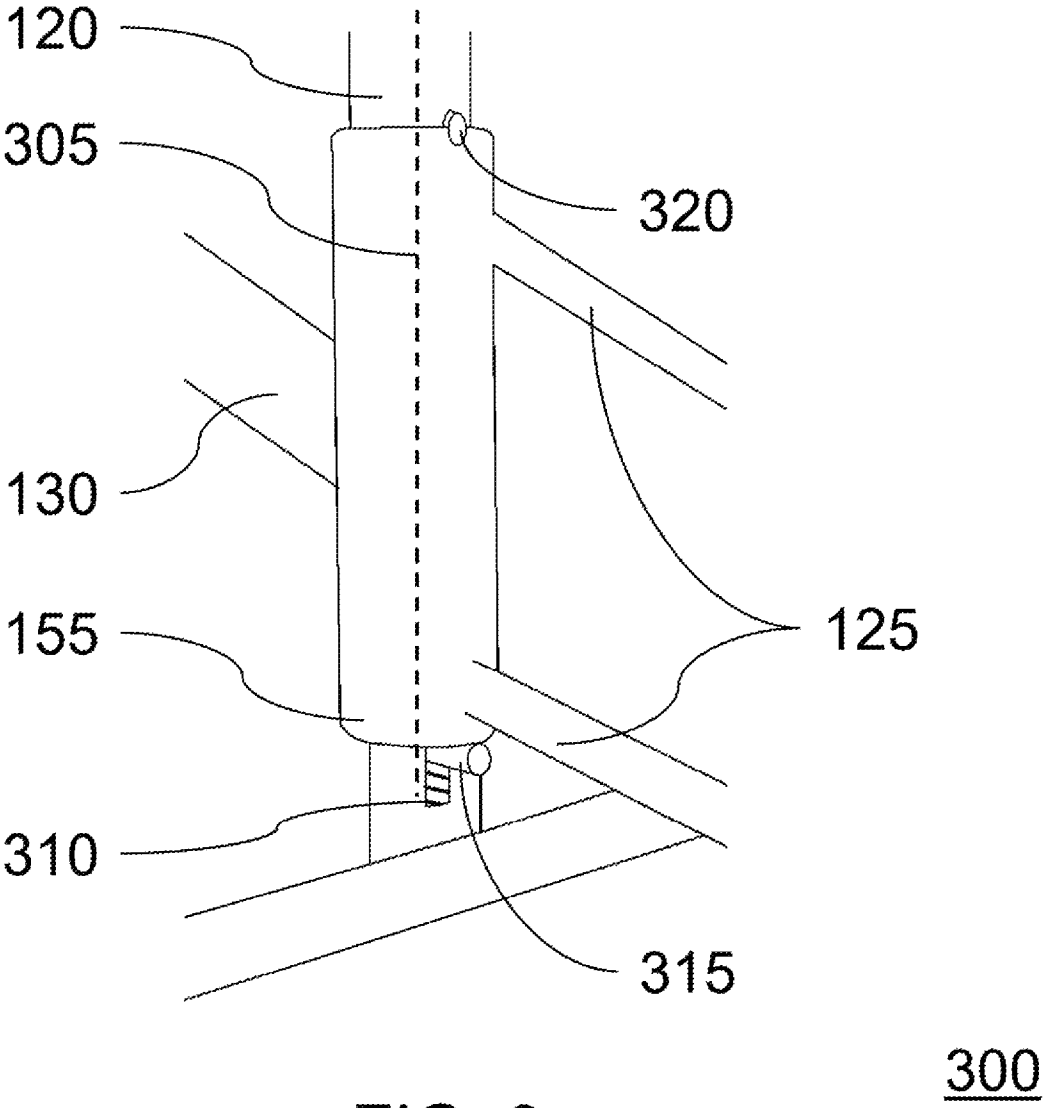
FIG. 3 illustrates a biasing mechanism.

FIG. 3 illustrates a biasing mechanism 300 that may be used to bias the parallel chin-up handle 130 of the chin-up apparatus 100 into the exercise configuration. The biasing mechanism 300 includes the door header hook 125 and the parallel chin-up handles 130 attached to the sleeve 155, around the connecting member 120. The connecting member 120 is a tube with a circular cross section and a center axis 305. The tube has a slot 310 running parallel to the center axis 305. A first pin 315 (also known as a pushing pin), extending beyond the connecting member 120 and perpendicular to the center axis 305, passes in the slot 310. A spring, inside the connecting member 120, pushes on the first pin 315 that pushes the sleeve 155 that causes the other end of the sleeve to push against a second pin 320 (also known as a retaining pin) that goes through connecting member 120. The sleeve 155 has a detent for the second pin 320 to move that biases the sleeve 155 to the exercise configuration. Optionally there may be a second bias position for the flat configuration, for example a second detent for the second pin 320.

Figure 4:
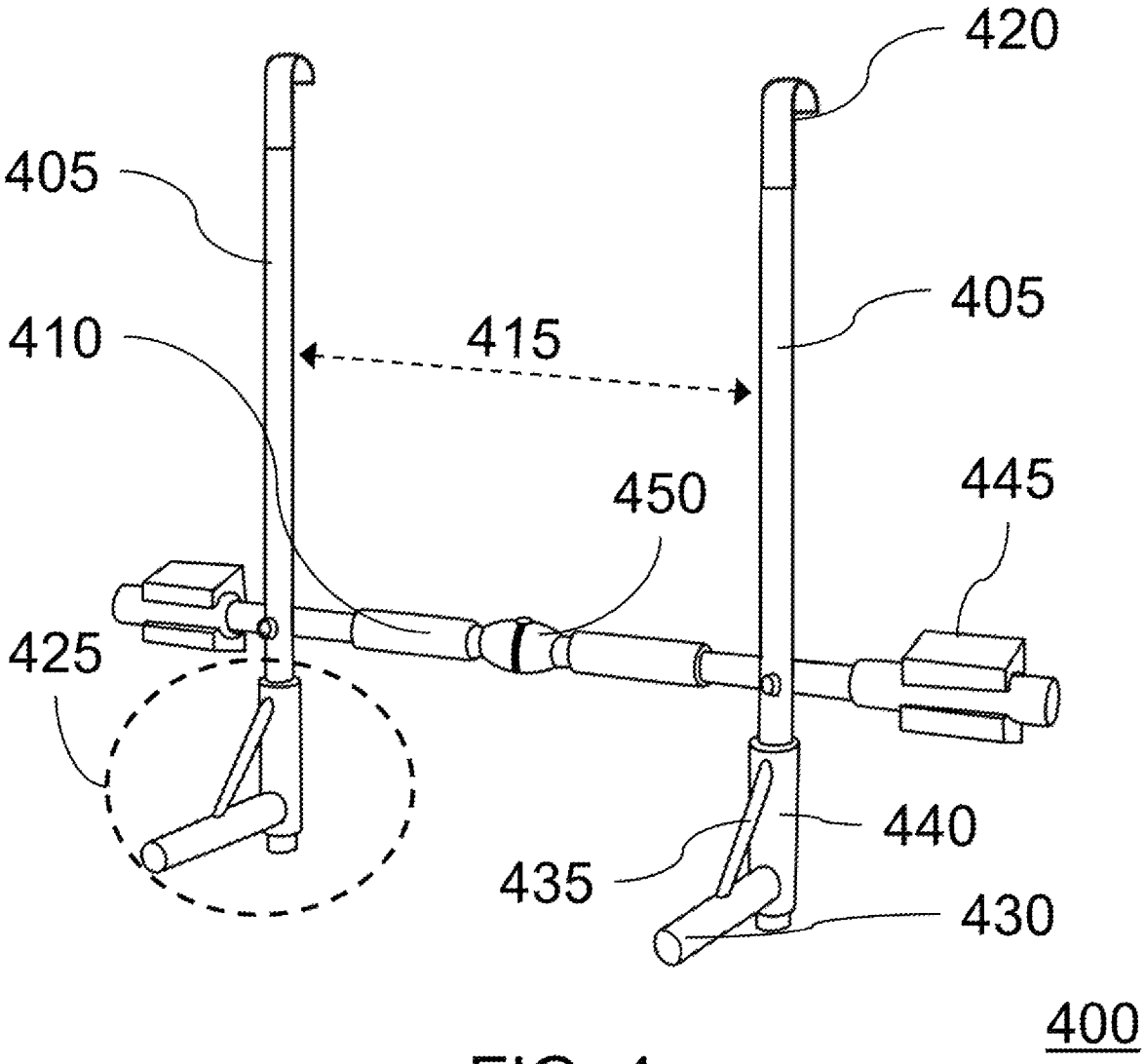
FIG. 4 illustrates a dip exercise apparatus in an exercise configuration.

FIG. 4 illustrates a dip exercise apparatus 400 in an exercise configuration. The dip exercise apparatus 400 has two vertical members 405 that are kept spaced apart at a predefined distance 415 by a horizontal connecting member 410. The horizontal connecting member 410 may be foldable, for example with a joint 450 in the middle. In the exercise configuration the horizontal connecting member 410 is extended, for example straight with no bend at the joint. At the end of the horizontal connecting member 410 there may be frame protectors 445.

The vertical member 405 has a top end 420 and a bottom end 425. The top ends 420 may have a hook shape or other shape that enables the dip exercise apparatus 400 to be suspended from a support, for example the support may be a horizontal rod, like the bottom horizontal member 115 or the top horizontal member 110 of the chin-up apparatus 100. The top ends 420 may have the hooks oriented so they are aligned so they can hook over a single rod, as shown, or the hooks could be oriented another direction for example facing each other to attach to the parallel chin-up handle 130, the connecting member 120 or the sleeve 155 when in the chin-up apparatus 100 is in the exercise configuration. The hooks maybe configured such that the hooks can attach to any support that can enable the dip exercise apparatus 400 to be suspended to be used for exercise.

The vertical member 405 has a bottom end 425 shown with a bottom grip 430 in the exercise configuration. Supporting the bottom grip 430 is a diagonal support 435 that connects on an angle from the top of a bottom sleeve 440 to the rear of the bottom grip 430. In the exercise configuration, the bottom grip 430 is substantially perpendicular to the plane containing the two vertical members 405. The bottom grips 430 may be used to do dip exercises, inverted body weight row exercises, leg raises, inverse level and other exercises.

The bottom end 425 may rotate on the vertical member 405, for example the bottom sleeve 440 may rotate around the axis of the vertical member 405. Alternatively, the bottom end 425 may lack the diagonal support 435 and the bottom grips 430 may attach to the vertical member 405 via a horizontal bolt and flip up to be more aligned to the vertical member 405, and in some configurations flip up and be parallel to the vertical member 405.

Figure 5:
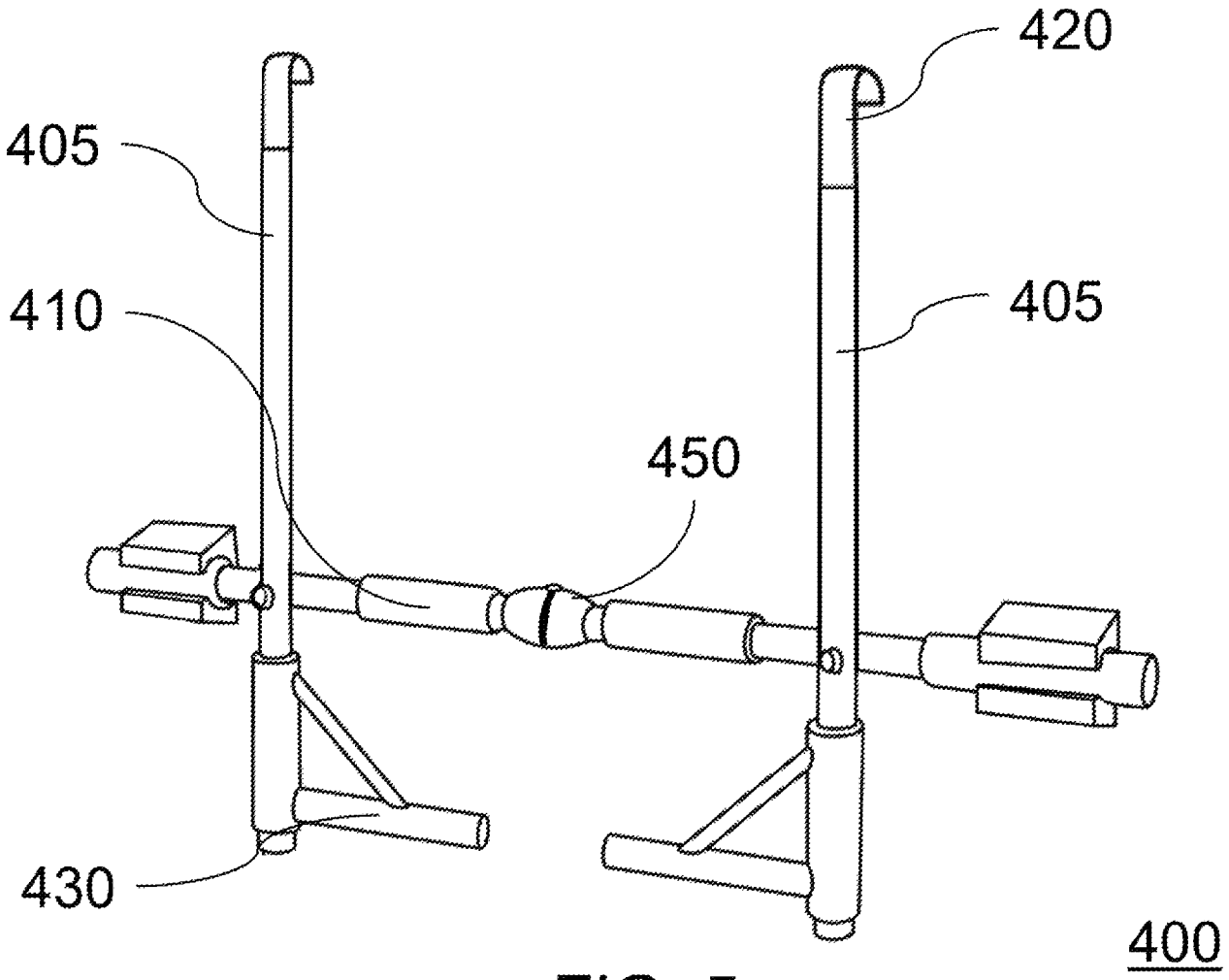
FIG. 5 illustrates the dip exercise apparatus in a flat configuration.

FIG. 5 illustrates the dip exercise apparatus 400 in a flat configuration with the bottom grips 430 rotated around the axis of the vertical member 405 to be aligned to the horizontal connecting member 410. For example, the bottom grips 430 may be rotated inwards by approximately 90 degrees so the bottom grips 430 become interior to and coplanar with the two vertical members 405. Alternatively, the flat configuration may find the bottom grips 430 rotated outwards by approximately 90 degrees so the bottom grips 430 are coplanar and exterior to the two vertical members 405. In the flat configuration the horizontal connecting member 410 is straight, i.e. fully extended at the joint 450.

The dip exercise apparatus 400 may transition between the exercise configuration and the flat configuration. In the exercise configuration the bottom handle 430 is in a perpendicular position where the bottom handle 430 is perpendicular to the plane containing the vertical members 405. In the flat configuration the bottom grip 430 is no longer perpendicular to the plane but rather in an aligned position. In the aligned position the bottom grip 430 is oriented to have the dip exercise apparatus 400 be flatter, for example the bottom grip 430 may be aligned to the horizontal connecting member 410 or co-planer with the two vertical members 405.

The dip exercise apparatus 400 may have a biasing mechanism to bias the bottom grips 430 into the perpendicular position, and possibly also into the flat configuration. If the bottom end 425 rotates around the axis of the vertical member 405 then the biasing mechanism may be like the biasing mechanism 300 described for the parallel chin-up handles. The biasing mechanism may bias the bottom grip to the perpendicular position for the exercise configuration of the dip exercise apparatus. The biasing mechanism may bias the bottom grips into the aligned position.

Figure 6:
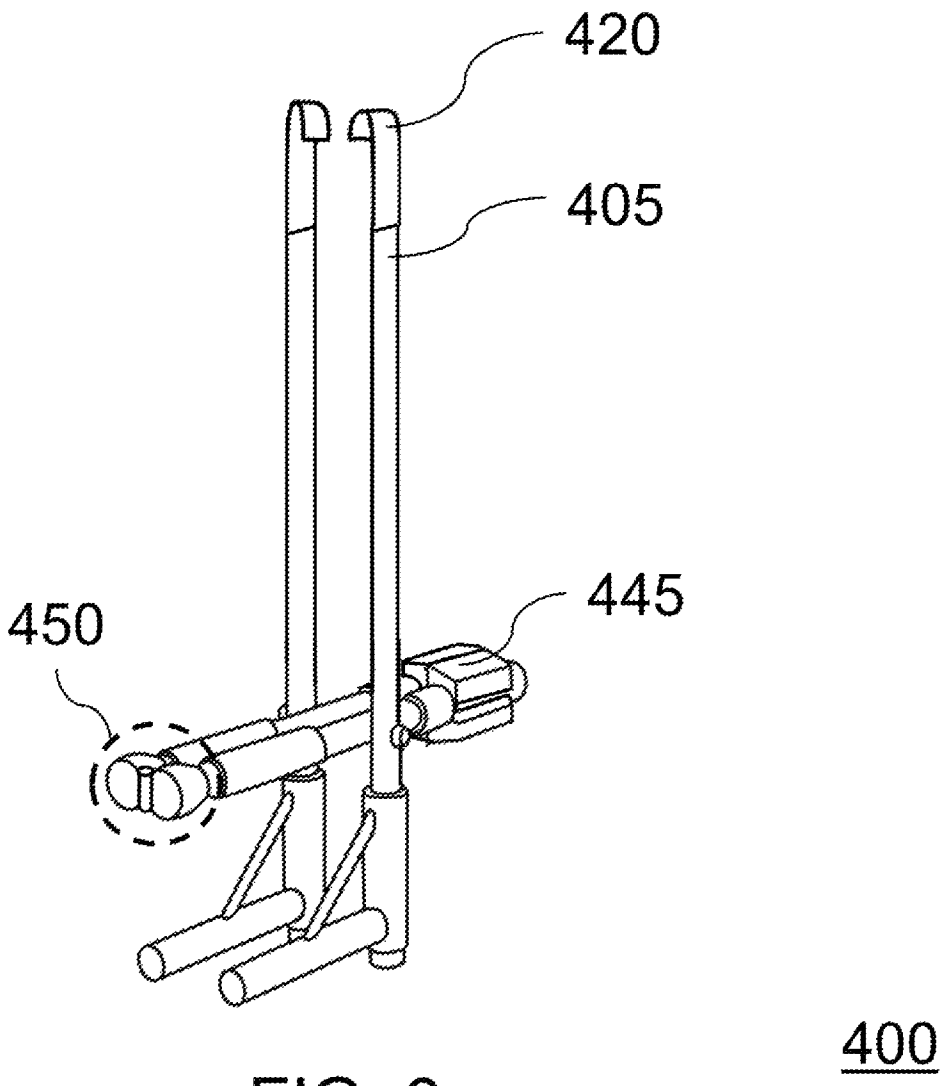
FIG. 6 illustrates the dip exercise apparatus in a double flat configuration.

FIG. 6 illustrates the dip exercise apparatus 400 in a double flat configuration where the horizontal connecting member 410 is bent at the joint 450, for example folded in half. In the double flat configuration, the bottom grips 430 and the two halves of the horizontal connecting member 410 may be parallel.

In the double flat configuration, the horizontal connecting member 410 is folded in half at the joint 450 as shown with the axis of the joint 450 being parallel to the vertical members 405. When folded the two halves of the horizontal connecting member 410 may touch back to back and the vertical members are separated by the two halves of the horizontal connecting member 410. Alternatively, the two halves may hinge to bring the two vertical members together. If the connection between the horizontal connecting member 410 and the vertical member 405 is allowed to pivot, then the vertical members 405 could be rotate to align being roughly parallel and provides a long skinny orientation with hooks on the end that can be easily stored.

Alternately the horizontal connecting member 410 could 'fold-up' if joint 450 has a hinge axis that is perpendicular to the plane containing the two vertical members 405. In the fold-up double flat configuration if the connection between the horizontal member and the vertical member is allowed to pivot the fold-up double flat configuration may be long and skinny with the vertical members and the halves of the horizontal member being roughly parallel or generally aligned. If the fold-up configuration the joint 450 may have a latch to keep the horizontal connecting member 410 straight. This may be particularly useful if the joint 450 is a hinge that opens downward toward the ground.

Figure 7:
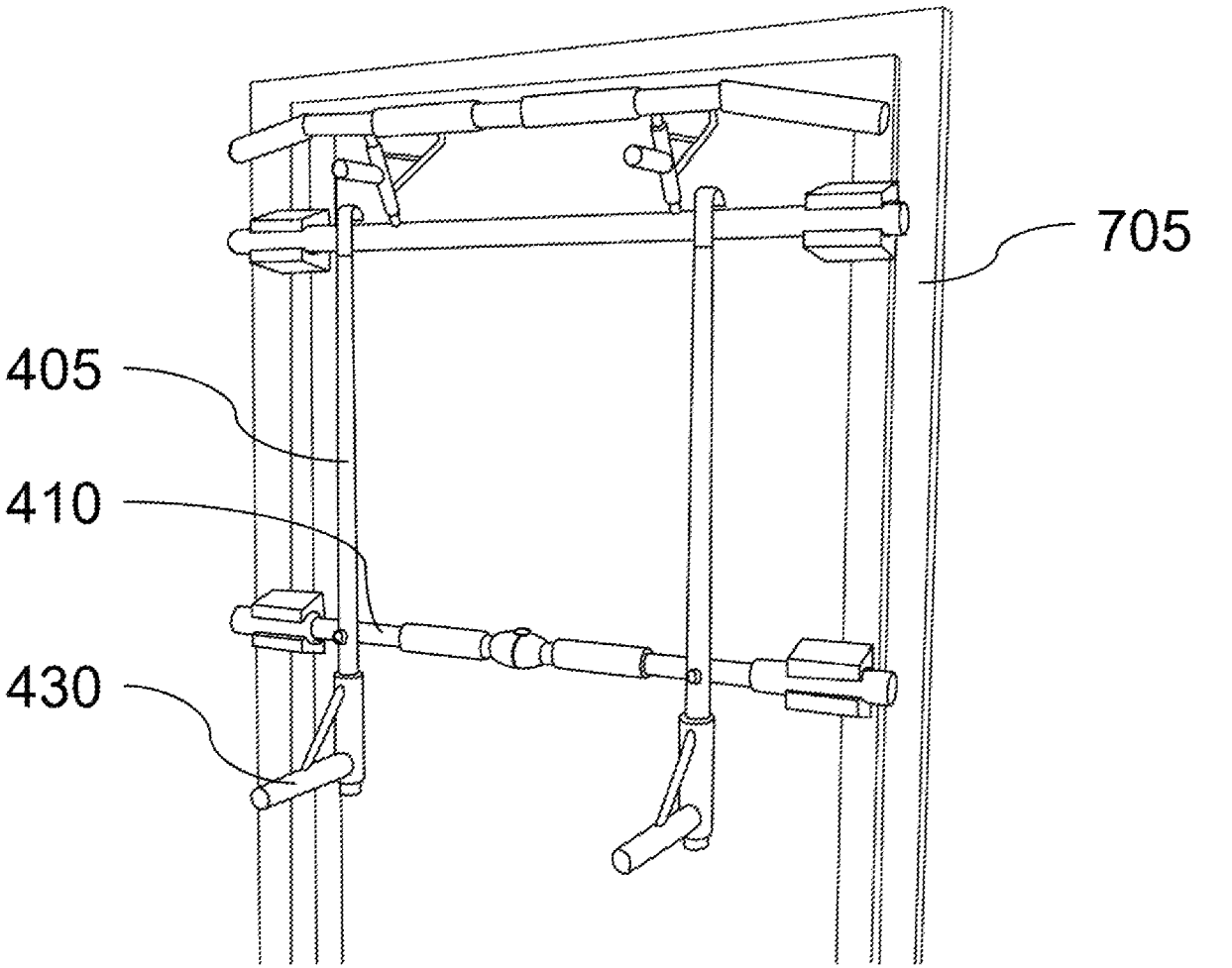
FIG. 7 illustrates the dip exercise device suspended from the chin-up apparatus secured to a door frame.

FIG. 7 illustrates a foldable exercise apparatus 700 composed of the dip exercise apparatus 400 suspended from the chin-up apparatus 100. The chin-up apparatus 100 is secured to a door frame 705. The dip exercise apparatus 400 is shown suspended from the chin-up apparatus 100 via the bottom horizontal member 115.

The embodiments described in this document fail to limit the scope of the disclosure, but rather provide examples to help understand what is disclosed. What is described in this document may be embodied in forms that are different from then the embodiments disclosed without departing from the scope and spirit of the disclosure.

Accordingly, it is to be understood that the above description is intended to be illustrative and not restrictive. Many embodiments and applications other than the examples provided would be apparent upon reading the above description. The scope should not be determined with reference to the above description, but rather should instead be determined with reference to the appended claims along with the full scope of equivalents to which such claims are entitled. It is anticipated and expected that future developments will occur in the technologies discussed, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary is made in this document. The use of the singular articles such as "a," "the," "said," etc. should be read to recite one or more of the indicated elements unless a claim recites an explicit limitation to the contrary.

The Abstract of the Disclosure is provided to allow the reader to quickly ascertain the nature of the disclosure. It is submitted with the understanding that it fails to impact or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of the disclosed embodiments. The following claims are hereby incorporated into the Detailed Description, with each claim standing on its own as a separately claimed subject matter.

What is claimed is:

1. A foldable exercise device comprising:

a dip exercise apparatus with:

two vertical members, where each vertical member has a top end and a bottom end, where the top end is configured to suspend the dip exercise apparatus from a chin-up apparatus, where the bottom end has a bottom grip, where the bottom grip can be rotated from a flat configuration to an exercise configuration, and a bottom grip biasing mechanism that biases the bottom grip to the exercise configuration; and a horizontal connecting member configured to keep the two vertical members spaced apart at a predefined distance, in the exercise configuration the bottom grips are substantially perpendicular to the two vertical members and the horizontal connecting member and when suspended can be used to do dip exercises, and in the flat configuration the bottom grips and the horizontal connecting member are substantially parallel.

2. A foldable exercise device of claim 1, further comprising a chin-up apparatus with:

a top horizontal member;

a bottom horizontal member spaced apart from the top horizontal member; and two connecting members connecting the top horizontal member and the bottom horizontal member, where each connecting member has a door header hook and a parallel chin-up handle that rotate on the connecting member from a flat configuration to an exercise configuration, where the door header hook and the parallel chin-up handle are on opposite sides of the connecting members, in the exercise configuration the door header hooks and parallel chin-up handles are roughly perpendicular to the bottom horizontal member and the foldable exercise device can releasably engage the door frame with the bottom horizontal member pressing against the front of the vertical door jams and with the door header hook engaged with the back side of the door frame header and the parallel chin-up handles extends away from the door frame parallel to each other and the parallel chin-up handles are available for neutral chin-ups, and in the flat configuration the door header hooks, the parallel chin-up handles, the two connecting members, the top horizontal member and the bottom horizontal member are substantially coplanar.

3. A foldable exercise device as claimed in claim 1, where the horizontal connecting member is foldable.

4. A foldable exercise device of claim 1, where the bottom grip biasing mechanism includes a sleeve that is around each of the vertical members and the bottom grip is attached to the sleeve, where the vertical member is a tube with a circular cross section and the tube has a center axis and there is a slot in the tube running parallel to the axis in which passes a pushing pin that is perpendicular to the axis of the vertical member, the pushing pin extends beyond the vertical member, pushing on the pushing pin is a spring that is inside the vertical member, the pushing pin pushes the sleeve, the other end of the sleeve is pushing against a retaining pin that goes through the vertical member and the sleeve has a detent for the retaining pin to move into that biases the sleeve to the exercise configuration.

5. A foldable exercise device comprising:

a chin-up apparatus with:

a top horizontal member;

a bottom horizontal member spaced apart from the top horizontal member; and two connecting members connecting the top horizontal member and the bottom horizontal member, where each connecting member has a door header hook and a parallel chin-up handle that rotate on the connecting member from a flat configuration to an exercise configuration, where the door header hook and the parallel chin-up handle are on opposite sides of the connecting members, in the exercise configuration the door header hooks and parallel chin-up handles are roughly perpendicular to the bottom horizontal member and the chin-up apparatus can releasably engage a door frame with the bottom horizontal member pressing against the front of the vertical door jams and with the door header hook engaged with the back side of the door frame header and the parallel chin-up handles extend away from the door frame parallel to each other and the parallel chin-up handles are available for neutral chin-ups, and in the flat configuration the door header hooks, the parallel chin-up handles, the two connecting members, the top horizontal member and the bottom horizontal member are substantially coplanar.

6. A foldable exercise device as claimed in claim 5, further including:

a dip exercise apparatus with:

two vertical members, where each vertical member has a top end and a bottom end, where the top end is configured to suspend the dip exercise apparatus from the chin-up apparatus, and where the bottom end has a bottom grip, where the bottom grip can rotate from a flat configuration to an exercise configuration; and a horizontal connecting member configured to keep the two vertical members spaced apart at a predefined distance, in the exercise configuration the bottom grips are substantially perpendicular to the two vertical members and the horizontal connecting member and when suspended from the chin-up apparatus can be used to do dip exercises, and in the flat configuration the bottom grips and the horizontal connecting member are substantially parallel.

7. A foldable exercise device as claimed in claim 5 where rotation of the door header hook causes rotation of the parallel chin-up handle.

8. A foldable exercise device as claimed in claim 5 where the door header hook is rigidly attached to the parallel chin-up handle.

9. A foldable exercise device as claimed in claim 5 where the connecting member is straight with a round cross section and there is a sleeve that is around the connecting member and the door header hook and the parallel chin-up handle are attached to the sleeve.

10. A foldable exercise device as claimed in claim 5 further comprising a chin-up bar biasing mechanism, where the chin-up bar biasing mechanism biases the parallel chin-up handle into the exercise configuration.

11. A foldable exercise device as claimed in claim 10, where the chin-up bar biasing mechanism includes a sleeve that is around the connecting member, where the door header hook and the parallel chin-up handle are attached to the sleeve, where the connecting member is a tube with a circular cross section, the tube has a center axis, and there is a slot in the tube running parallel to the axis of the connecting member, in the slot passes a first pin that is perpendicular to the axis of the connecting member, the first pin extends beyond the connecting member, pushing on the first pin is a spring that is inside the connecting member, the first pin pushes the sleeve, the other end of the sleeve is pushing against a second pin that goes through the connecting member and the sleeve has a detent for the second pin to move into that biases the sleeve to the exercise configuration.

12. A foldable exercise device comprising:

a chin-up exercise apparatus, where the chin-up exercise apparatus has a top horizontal member and a bottom horizontal member connected by two connecting members, where each connecting member has a door header hook and a parallel chin-up handle that rotate on the connecting member from a flat configuration to an exercise configuration, where the door header hook and parallel chin-up handle are on opposite sides of the two connecting members, in the exercise configuration the chin-up exercise apparatus can releasably engage a door frame with the bottom horizontal member contacting the front side of the door frame by pressing against the vertical door jams of the door frame and the door header hook can engaging with the back side of the door by contacting a door frame header and the parallel chin-up handles can be used to do neutral chin-ups; and a dip exercise apparatus suspendable from the chin-up exercise apparatus, where the dip exercise apparatus has two vertical members, where each vertical member has a top end and a bottom end, where the top end is configured to suspend the dip exercise apparatus from the chin-up exercise apparatus, where the bottom end has a bottom grip, where the bottom grip can be rotated from a flat configuration to an exercise configuration, where the two vertical members are spaced apart at a predefined distance by a horizontal connecting member, in the exercise configuration the bottom grips are substantially perpendicular to the two vertical members and the horizontal connecting member and when suspended from the chin-up exercise apparatus can be used to do dip exercises, and in the flat configuration the bottom grips and the horizontal connecting member are substantially parallel.

13. A foldable exercise device as claimed in claim 12, where rotation of the door header hook causes rotation of the parallel chin-up handle.

14. A foldable exercise device as claimed in claim 12, where the connecting member is straight with a round cross section and there is a sleeve that is around the connecting member, where the door header hook and the parallel chin-up handle are attached to the sleeve.

15. A foldable exercise device as claimed in claim 12, further comprising a chin-up bar biasing mechanism, where the chin-up bar biasing mechanism biases the parallel chin-up handle into the exercise configuration.

16. A foldable exercise device as claimed in claim 15, where the chin-up bar biasing mechanism includes a sleeve that is around the connecting member, and the door header hook and the parallel chin-up handle are attached to the sleeve, where the connecting member is a tube with a circular cross section, the tube has an axis and there is a slot in the tube running parallel to the axis in which passes a first pin that is perpendicular to the axis of the connecting member, the first pin extends beyond the connecting member, pushing on the first pin is a spring that is inside the connecting member, the first pin pushes the sleeve, the other end of the sleeve is pushing against a second pin that goes through the connecting member and the sleeve has a detent for the second pin to move into that biases the sleeve to the exercise configuration.

17. A foldable exercise device as claimed in claim 12, where the horizontal connecting member is foldable.

18. A foldable exercise device as claimed in claim 12 further comprising a bottom grip biasing mechanism that biases the bottom grip to the exercise configuration.

19. A foldable exercise device as claimed in claim 18, where the bottom grip biasing mechanism includes a sleeve that is around the vertical members and the rotatable handles are attached to the sleeve, where the vertical member is a tube with a circular cross section and there is a slot in the tube running parallel to the axis in which passes a pushing pin that is perpendicular to the axis of the vertical member, the pushing pin extends beyond the vertical member, pushing on the pushing pin is a spring that is inside the vertical member, the pushing pin pushes the sleeve, the other end of the sleeve is pushing against a retaining pin that goes through the vertical member and the sleeve has a detent for the retaining pin to move into that biases the sleeve to the exercise configuration.

* * * * *